US006371194B1

(12) United States Patent
Steinhäuser

(10) Patent No.: US 6,371,194 B1
(45) Date of Patent: Apr. 16, 2002

(54) METHOD FOR PRODUCING CORE PREFORMS AND RECYCLING CORE SAND FOR A FOUNDRY

(75) Inventor: Thomas Steinhäuser, Goch-Hommersum (DE)

(73) Assignee: VAW aluminium AG, Bonn (DE)

( * ) Notice: Subject to any disclaimer, the term of this patent is extended or adjusted under 35 U.S.C. 154(b) by 0 days.

(21) Appl. No.: 09/866,489

(22) Filed: May 25, 2001

Related U.S. Application Data

(63) Continuation-in-part of application No. 09/242,236, filed as application No. PCT/EP97/04072 on Jul. 26, 1997, now abandoned.

(30) Foreign Application Priority Data

Aug. 9, 1996 (DE) ..... 196 32 293

(51) Int. Cl.[7] ..... B22C 1/18; B22C 9/10

(52) U.S. Cl. ..... 164/5; 164/528; 164/28; 164/7.1

(58) Field of Search ..... 164/528, 529, 164/5, 15, 16, 28, 7.1

(56) References Cited

U.S. PATENT DOCUMENTS

| | | | |
|---|---|---|---|
| 4,226,277 A | 10/1980 | Matalon | |
| 4,960,162 A | 10/1990 | Millager | 164/5 |

FOREIGN PATENT DOCUMENTS

| | | |
|---|---|---|
| GB | 952788 | 3/1964 |
| WO | WO 86/00033 | 1/1986 |
| WO | WO 89/05204 | 6/1989 |

OTHER PUBLICATIONS

Von Prof.Dr.–Ing. habil. Eckart Flemming et al., "Formstoffe und Formverfahren", Deutscher Verlag für Grundstoffindustrie, Leipzig Stuttgart 1993, pp. 78–84 and 272–274.

Abstract, G.S. Cole, "Effects of Microwave Heating on Core Processing", AFS Transactions, pp. 227–236.

R.A. Jones et al., "Dehydration Hardening of Sodium Silicate Bonded Moulds", Foundry Trade Journal, May 3, 1962, pp. 537–544.

R.M. MacDonald, "The Rebonding of Reclaimed Silicate Sands", Modern Casting, Jun. 1976, vol. 66, No. 6, pp. 66–67.

Patent Abstracts of Japan for Publication No. 61067539.

Patent Abstracts of Japan for Publication No. 01215433.

Dipl.–Ing. Gregor Brümmer, Landshut, Germany entitled"Untersuchungen zur wechselseitigen Beeinflussung von Kreisläufen aus bentonitgebundenen Formstoffen sowie Wasserglas–und resolgebundenen $CO_2$ Kernsanden", May 29, 1995.

*Primary Examiner*—Kuang Y. Lin
(74) *Attorney, Agent, or Firm*—Darby & Darby

(57) ABSTRACT

The invention relates to a method for the production of core preforms for foundry in which a) a mixture of inorganic, refractory foundry sand and a water glass-based inorganic binder is produced, b) the mixture is poured into a heated core box c) the water contained in the mixture is withdrawn by a physical method and d) the core preform is taken out of the core box. The process is characterized by the fact that e) the heated core box is subjected to a depression during filling f) the temperature/dwell time is adjusted after the closing of the core box so that a dimensionally stable and good bearing shell is formed on the edge of the preform g) the preform is immediately removed after opening of the core box and, under the effect of microwaves, is subjected to a complete drying.

3 Claims, 7 Drawing Sheets

METHOD FOR PRODUCING CORE PREFORMS AND RECYCLING CORE SAND FOR A FOUNDRY

This is a continuation-in-part application of pending prior application Ser. No. 09/242,236 filed Feb. 5, 1999 entitled Method for the Production of Core Preforms and Recycling Core Sand for Foundry, now abandoned, which is a 371 of PCT/EP97/04072, filed Jul. 26, 1997.

BACKGROUND OF THE INVENTION

The invention relates to a method for producing core preforms for a foundry, wherein a mixture of an inorganic, refractory foundry sand and a water-glass-based inorganic binder is produced, the mixture is fed into a heated core box, the water contained in the mixture is removed by a physical method, and the core preform is removed from the core box. The invention also relates to a method for making recycled core sand.

In 1962 an article was published in the journal "Foundry Trade Journal" describing hardening of sodium silicate-bound foundry sand through dehydration (see "Foundry Trade Journal", May 3, 1962, pp. 537–544).

The test samples consisted of a densified sand sodium silicate mixture. The test samples were dried by applying a vacuum in the range between 0.5 and 3 mm Hg and maintaining the vacuum until approximately 10 to 30% of the moisture was removed from the binder.

The tests relating to the drying process were performed at different temperatures between 100 and 500° C. Other tests related to studies to accelerate dehydration by adding $CO_2$ gas.

The article concluded that the addition of $CO_2$ gas is not essential for hardening the core preforms. It was therefore proposed to produce core preforms in practice by a "cold" process employing a vacuum pump with adequate capacity. This would eliminate the need for heating the core box, which was hitherto deemed essential because of the use of thermosetting resins.

It was, however, recognized that it may be difficult to manufacture large quantities of core preforms since large pumps with a high rotation speed would be required to produce an adequate vacuum. Another disadvantage is that between 8 and 16 minutes are required for vacuum drying, and such a long processing time does not lend itself to mass-production of the core preforms.

About 10 years later—while mostly resin-bound foundry sands were still in use—the journal AFS-Transactions, volume 86, pp. 227–236, published an article about "Effects of Microwave Heating on Processing of Core Preforms" by G. S. Cole. Cole describes the microwave treatment of organic binder systems and concludes that the binder fraction can be significantly reduced by using microwaves. This has significant environmental benefits since organic materials must be specially treated during casting and storage and for disposal. Even a microwave drying process, however, requires that precautions be taken to prevent the organic materials contained in the binder from escaping into the exhaust air.

The only non-organic binder material mentioned in Cole's article is a sodium silicate binder which is either mixed with complex ester hardeners or subjected to a "chemical drying process" using "conventional" $CO_2$ gas systems. This treatment may impair the decomposition characteristics of the core after casting, since the used core sand can only be partially regenerated due to lumps formed in the produced glass phases. The use of ester compounds should be avoided due to environmental concerns.

The problems associated with regeneration in the presence of glass phases were addressed in a Handbook entitled "Foundry Materials and Foundry Processes" published by the Deutscher Verlag für Grundstoffindustrie (pp. 80–81). FIG. 3.28 on page 83 of the Handbook illustrates the secondary mechanical strength of $CO_2$-hardened water-glass preforms as a function of the casting temperature. Over the past 30 years, this process has become the standard process for conventional and modified binder solutions and produces water-glass-bound foundry materials with the high temperature properties illustrated in FIG. 3.28. With this process, the foundry material has an increased tendency to sinter and may also not be able to adequately break down after casting. In addition, molten phases are produced which during subsequent cooling bind once again with the basic foundry material. The resulting secondary mechanical strength can be reduced by the following measures described on page 84 of the "Handbook":

1. by optimizing the foundry material recipe to reduce alkalinity;
2. by using water-glass solutions with a reduced binder fraction;
3. by adding additives to promote breakdown.

To this date, this problem has not been optimized satisfactorily. To dissolve the outer shells of the binder, which consist of dehydrated sodium silicate or of gel phases formed by chemical reactions as well as of crystallized molten phases and reaction products, the used foundry material must undergo an intensive wet chemical treatment. The ester-hardened foundry materials have partially elastic binder shells, which require a combination of thermal and mechanical separation methods.

In addition, WO-A-86/00033 describes a method for producing core preforms, wherein the foundry sand is mixed with water-glass which forms a binder. Water is removed from the mixture in a core box under the effect of microwaves. The core box is here constructed of a material which is transparent for microwaves, e.g., plastic, rubber or a multi-layer non-metallic material.

SUMMARY OF THE INVENTION

It is therefore an object of the present invention to provide a process for the manufacture of core preforms for foundries which does not have the disadvantages described above. The process provides an environmentally friendly and energy-saving method for the mass-production of components in complex shapes, in particular large-size core preforms. The produced components have a sufficiently high flexural strength for handling and a surface which is "smooth" in comparison with conventional core sand surfaces. The process also eliminates additives otherwise required for promoting breakdown. When the "used sand" is recycled, it is no longer necessary to break up or separate organic materials and to treat the used sand by wet-chemical processes. The process produces a recycling core sand with physical properties that are identical to those of the initially used raw material.

DETAILED DESCRIPTION OF THE INVENTION

Figure 1:
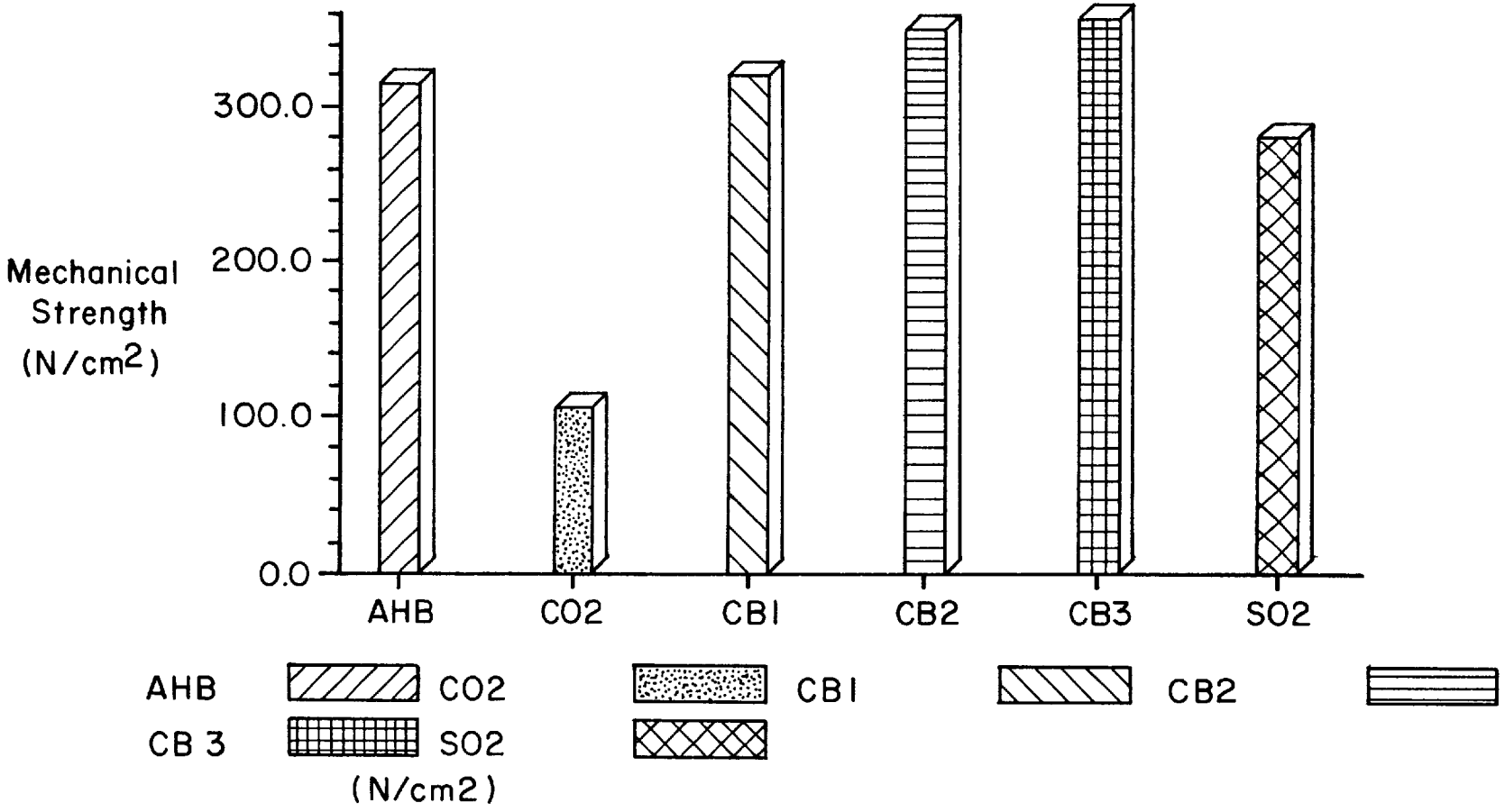
FIG. 1 shows a comparison of the flexural strength of AWB with that of other core systems for different core storage times (KLZ)

FIG. 1 illustrates different foundry material binder systems under controlled constant conditions. The storage time of the foundry material is here 0 minutes, i.e., the foundry material is processed into preforms immediately after mixing. The core storage time is 60 minutes, i.e., after casting the preform is stored for the predetermined time and then fractured.

The product of the invention is produced from 5 kg foundry sand H32 (AFS No. 48) with 2.5% binder in a vibrating mixer with a mixing time of 50 seconds and then processed on a core shooter of type H 2.5, i.e. a core shooter with a maximum capacity of 2.5 liters of sand per shot. The core box has a temperature of 150° C. The product was densified at an overpressure of 2.5 bar and remained in the core box for 8 seconds. The generated gases where extracted at a flow rate of 4 $m^3$/h before the core box was opened. The preform was then removed and dried by applying microwaves (600 watts) for 120 seconds. The corresponding flexural strength values are illustrated in FIG. 1 in the form of narrow hatched bars for a storage time of the foundry material of 0 minutes and a core storage time of 60 minutes.

A comparison product was produced with the Resol-$CO_2$-process by adding 2.7% binder fraction to the charge. The mixing time was 70 seconds and densification was performed at a negative pressure of −0.8 bar. The comparison product was then hardened in a $CO_2$ atmosphere at 1 bar for 8.5 seconds. The result is shown in FIG. 1 as "$CO_2$"-bar for comparison with the data of the invention at identical foundry material storage times of 0 minutes and core storage times of 60 minutes for all data.

Additional comparison products labeled CB1, CB2, CB3 (Cold Box) were processed with 0.8/0.8% DMEA. The comparison products are different sand materials from different suppliers. A two component system was added to the sand material hardened with DMEA. One component was an additive of 0.8% resin and the second component an additive of 0.8% isocyanate. Also produced with 1% epoxy/0.25% resin and oxidizer and tested was a sand system that was processed with $SO_2$ gas.

It was found that the flexural strength of the core preforms of the invention has significantly better values than that of the preforms hardened with $SO_2$ and $CO_2$ if the cores are immediately removed from the form without being stored.

Figure 4:
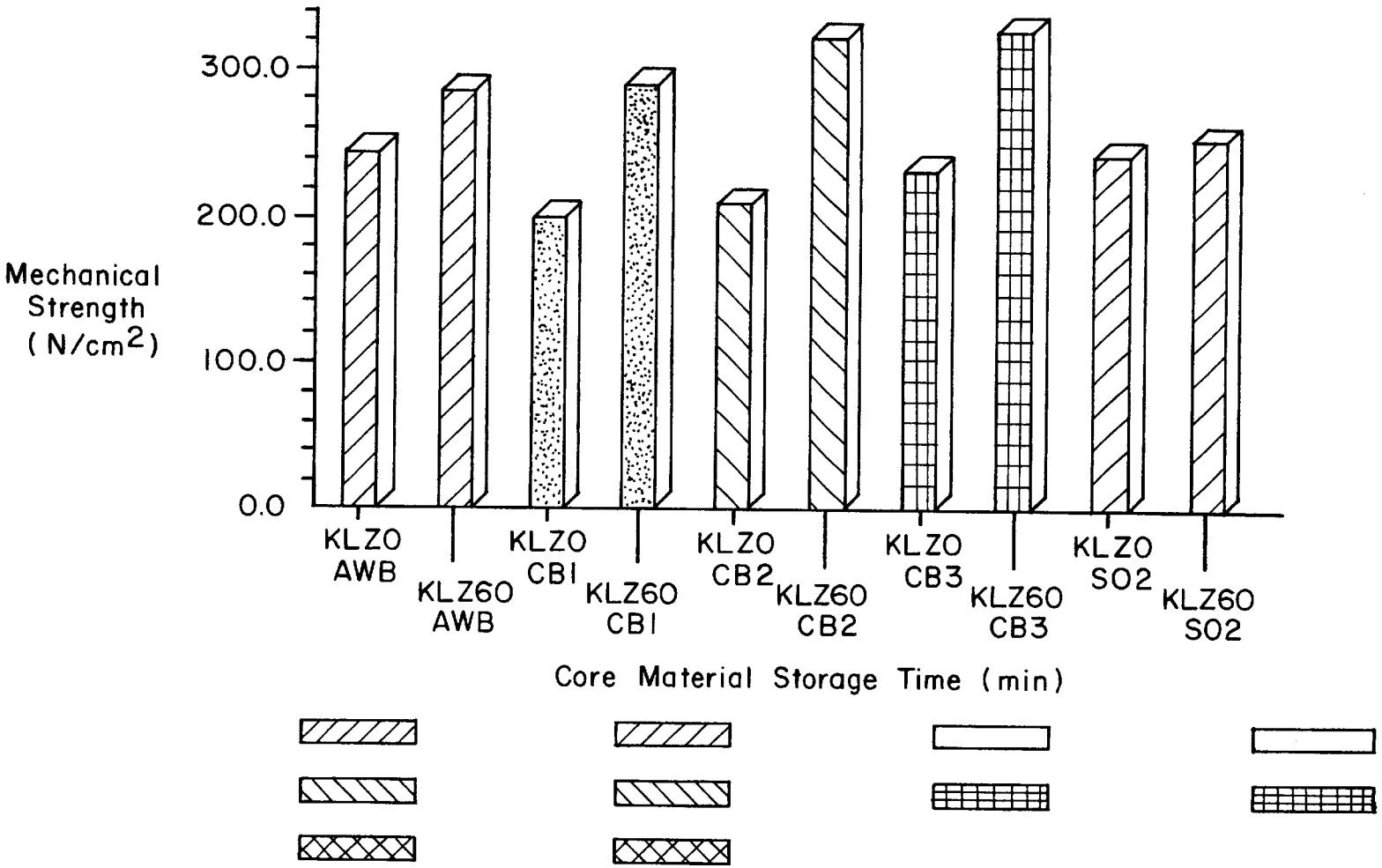
FIG. 4 shows a comparison of the flexural strength of the product according to the invention with that of three other systems CB1, CB2, CB3 for various core storage times.

Referring now to FIG. 4, a comparison between conventional cold box systems and the core preform of the invention for different core storage times and a storage time of the foundry material of 0 minutes shows that for FLZ=0 and KLZ=0, the products of the invention have significantly better flexural strength values than the comparison products. The diagram of FIG. 4 is expanded in FIG. 5 by adding different foundry material storage times. A figure comparing the reclaimed materials for different core storage times has been omitted, since the comparison methods provide stable preforms only after the organic components are removed.

Figure 5:
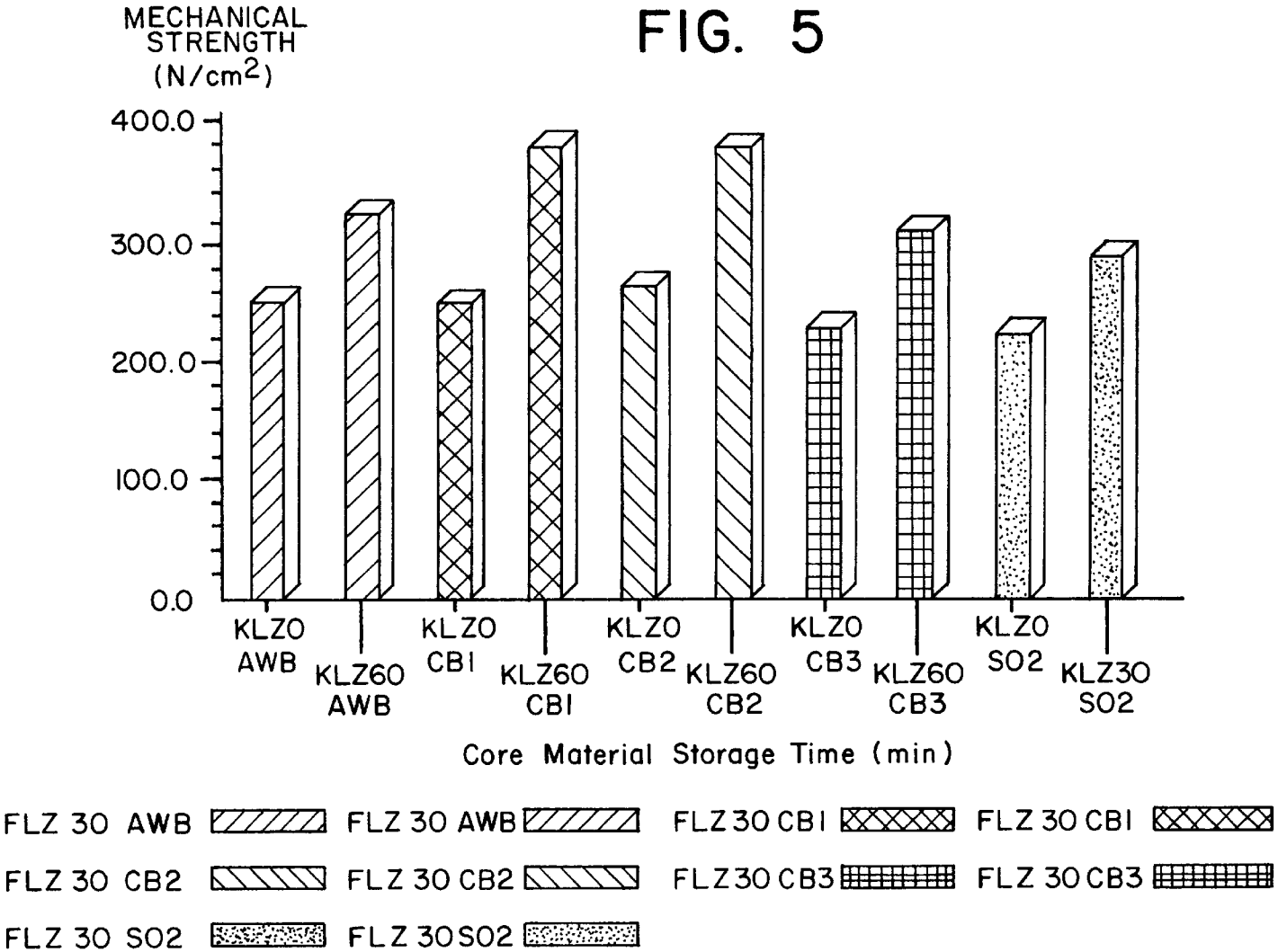
FIG. 5 shows a comparison of the flexural strength of the product according to the invention with that of three other systems for a constant storage time of the foundry material, but different core storage times.

As seen in FIG. 5, a comparison of the flexural strength of the core preforms according to the invention for different core storage times shows that the flexural strength of the product of the invention increases less noticeably than that of the comparison products.

Figure 2:
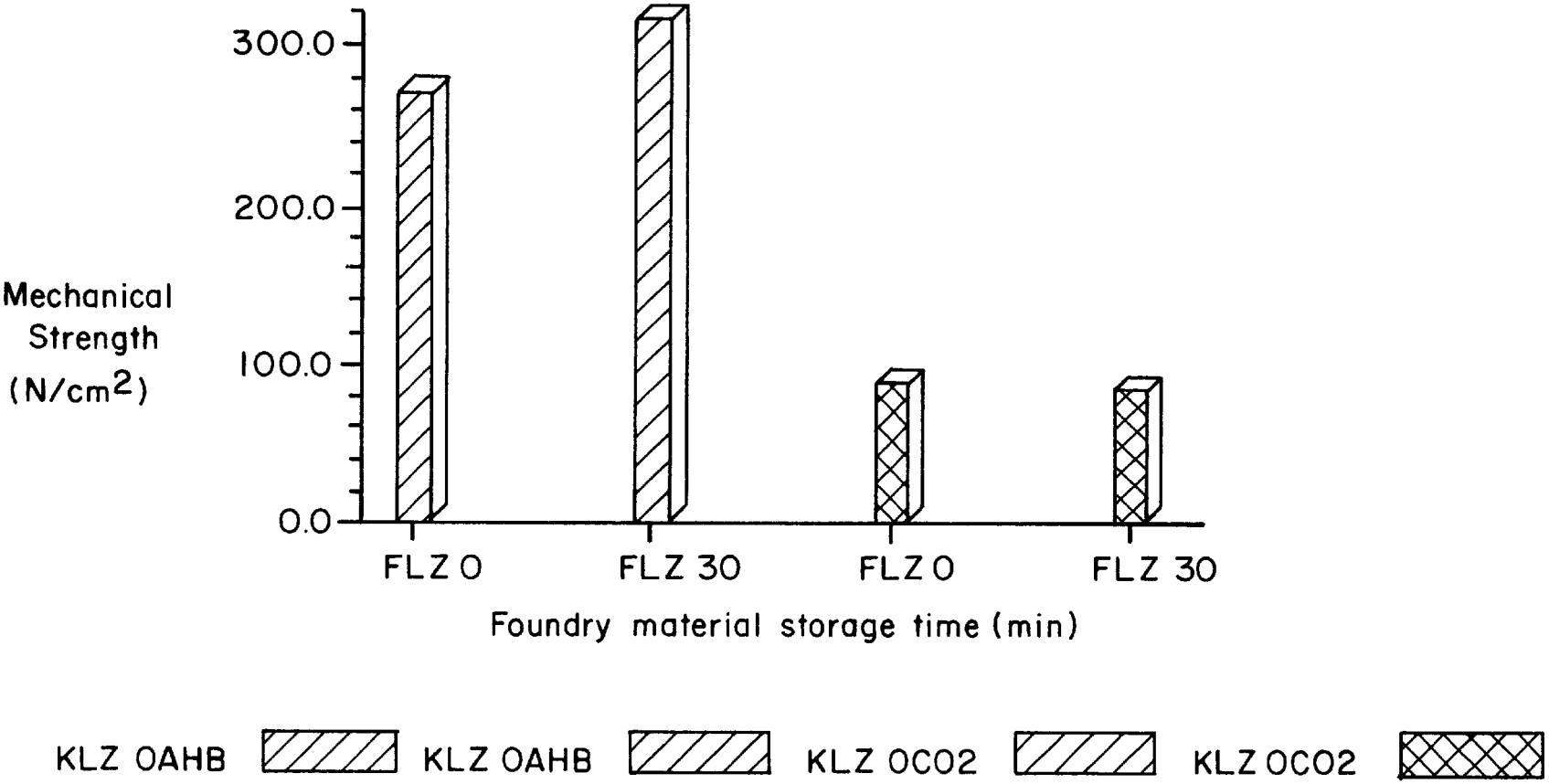
FIG. 2 shows a comparison of the flexural strength of AWB with that of other core systems for different storage time of the foundry material (FLZ)

FIG. 2 shows the dependence of the flexural strength on the foundry material storage time (FLZ) and the core storage time (KLZ). In this example, the AWB process is compared with the Resol-$CO_2$ process (the Resol-$CO_2$ process is similar to the classical water-glass process since hardening occurs through formation of a gel in the binder bridges). The AWB process is an inorganic warm box process.

FLZ 0: time indicated in minutes

FLZ 30: time indicated in minutes at KLZ 0.

The comparison between the two systems is based on the fresh sand base H32. The test parameters for the AWB process are listed on FIG. 3 on page 3/7 of WO98/06522. Resol-$CO_2$ process with 2.5% binder added to the charge, mixing time 70 seconds, densification under reduced pressure −0.8 bar, hardening over $CO_2$/1 bar/8.5 sec.

Figure 3:
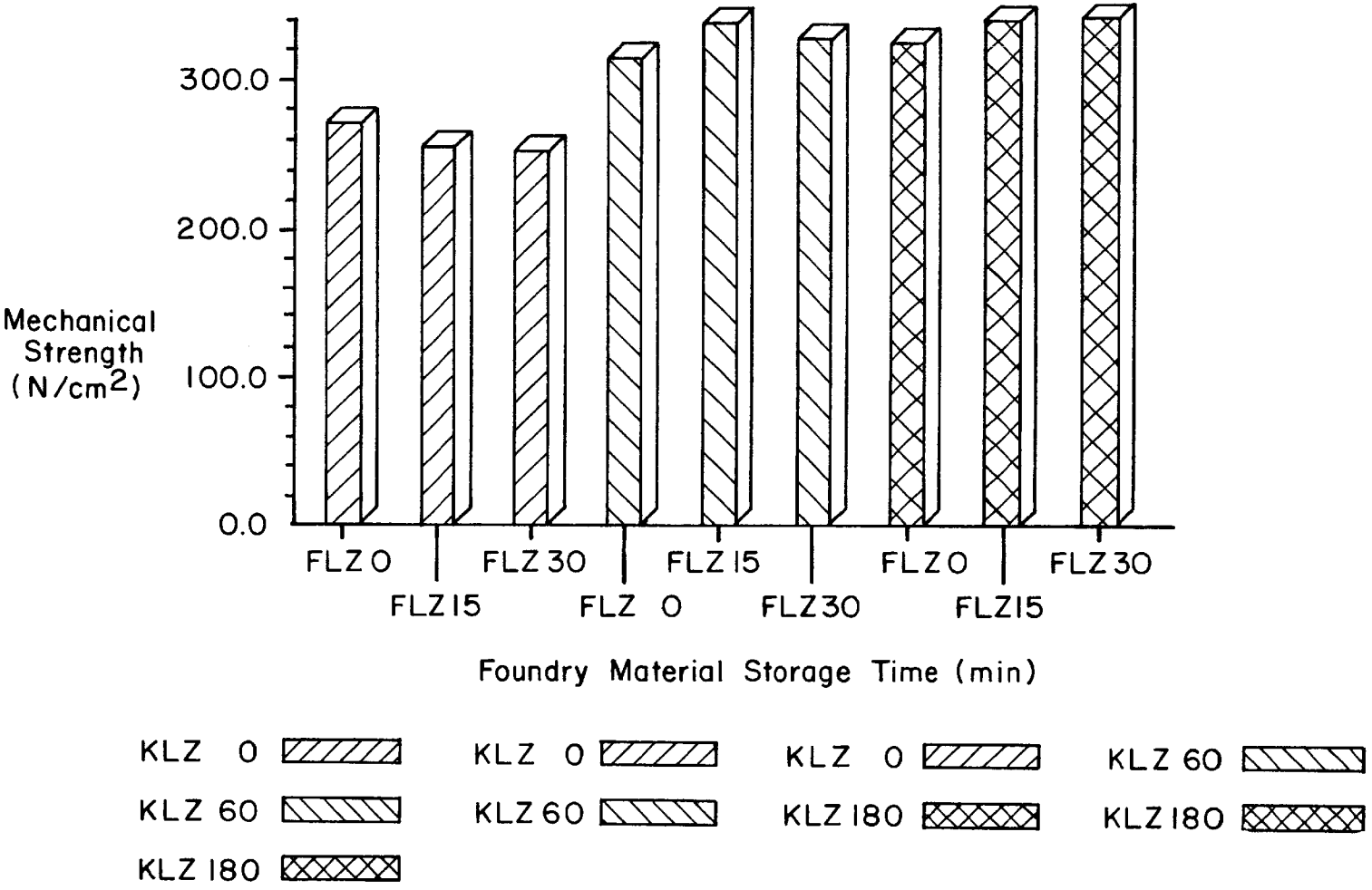
FIG. 3 shows a diagram of the flexural strength of the product according to the invention for various storage times of the foundry material and various core storage times.

FIG. 3 shows the dependence of the flexural strength on the foundry material storage time (FLZ) and the core storage time (KLZ) of the AWB process.

2.5% Binder

FLZ 0: time indicated in minutes

FLZ 15: time indicated in minutes

FLZ 30: time indicated in minutes

KLZ 0: time indicated in minutes

KLZ 60: time indicated in minutes

KLZ 180: time indicated in minutes

FLZ=foundry material storage time; KLZ=core storage time

Processing of a material consisting of 5 kg H32 in a vibrating mixer, mixing time 50 seconds, processing on a core shooter H 2.5.

Core box temperature 150° C.

Densification (shot pressure in the core shooter) at 2.5 bar with a mild vacuum (−0.6 bar) in the core box.

Resident time in the core box 8 seconds, with the core box exhausted at 4 $m^3$/h.

Microwave drying 120 seconds, 600 watts (Note: the binder contains 35% solid fraction).

The mechanical strength of the foundry materials illustrated in FIG. 4 was produced with the following sand systems: all sand systems where produced on the basis of H32 fresh sand base.

CB1 0.8/0.8% DMEA/HA cold box

CB2 0.8/0.8% DMEA/HA cold box

CB3 0.8/0.8% DMEA/HA cold box

SO2 1%/0.25% H/Oxide. Epoxy

The flexural strength is compared with that of other foundry material systems and shown in FIG. 4 for different core storage times (KLZ).

2.5% Binder AWB Process

KLZ 0: time indicated in minutes

KLZ 60: time indicated in minutes

FLZ 0: time indicated in minutes

FLZ=foundry material storage time; KLZ=core storage time

Like the sand systems of FIG. 4, these sand systems are also produced on the basis of H32 fresh sand base.

CB1 0.8/0.8% DMEA/HA cold box

CB2 0.8/0.8% DMEA/HA cold box

CB3 0.8/0.8% DMEA/HA cold box

SO2 1%/0.25% H/Oxide. Epoxy

The flexural strength is compared with that of other foundry material systems and shown in FIG. 5 for different core storage times (KLZ).

2.5% Binder AWB-process

KLZ 0: time indicated in minutes

KLZ 60: time indicated in minutes

FLZ 30: time indicated in minutes

FLZ=foundry material storage time; KLZ=core storage time

Figure 6:
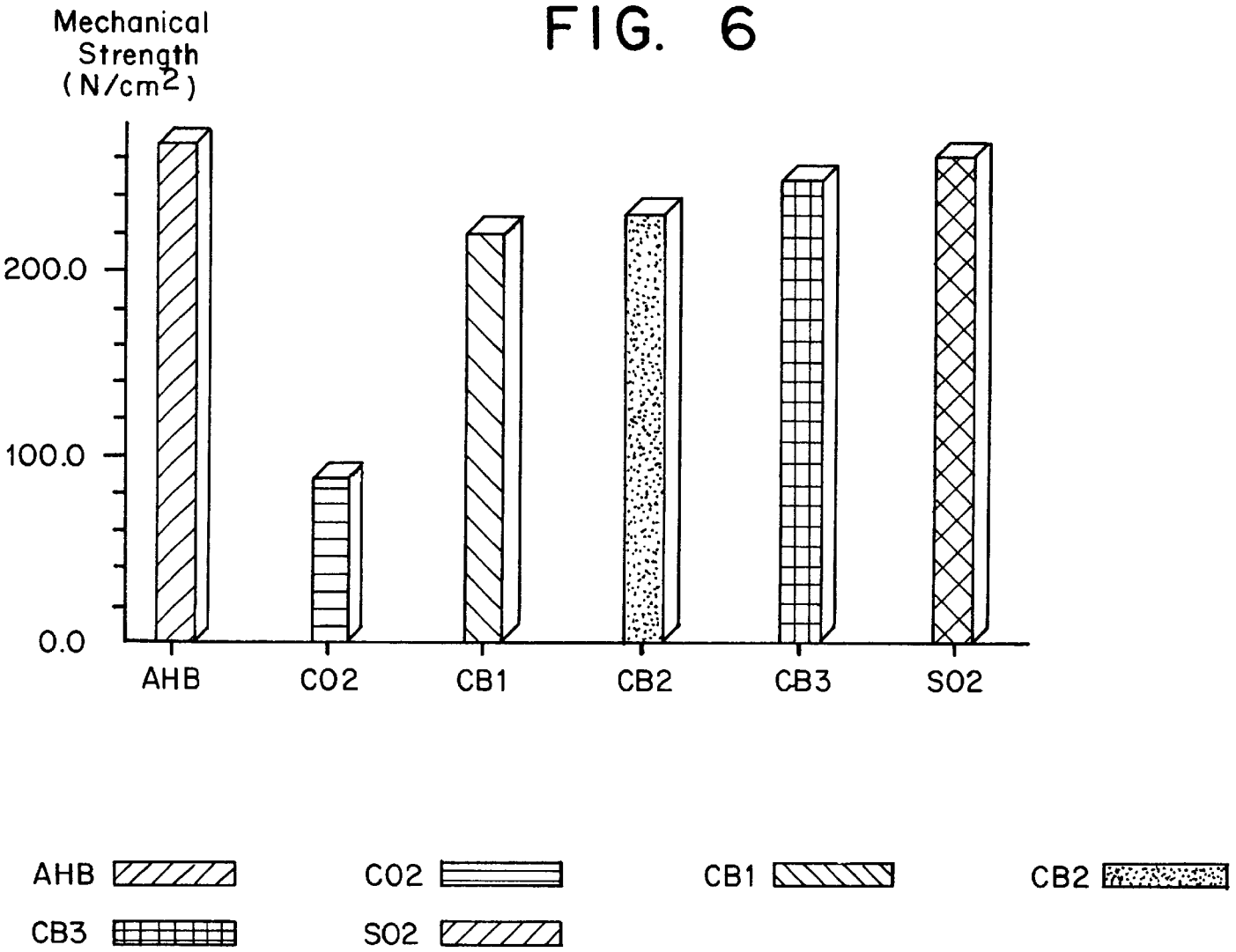
FIG. 6 shows a comparison of the flexural strength of the product according to the invention with that of three other products.

FIG. 6 shows different foundry material binder systems under controlled constant conditions. The foundry material storage time is 0 minutes, i.e., the foundry material is processed into preforms immediately after casting. The core storage time is 0 minutes, i.e., the preform is broken immediately after being cast.

FLZ=0 minutes

KLZ=0 minutes

All sand systems are produced on the basis of H32 fresh sand base in a vibrating mixer with a charge of 5 kg, i.e., in the same manner as in the examples described above.

Figure 7:
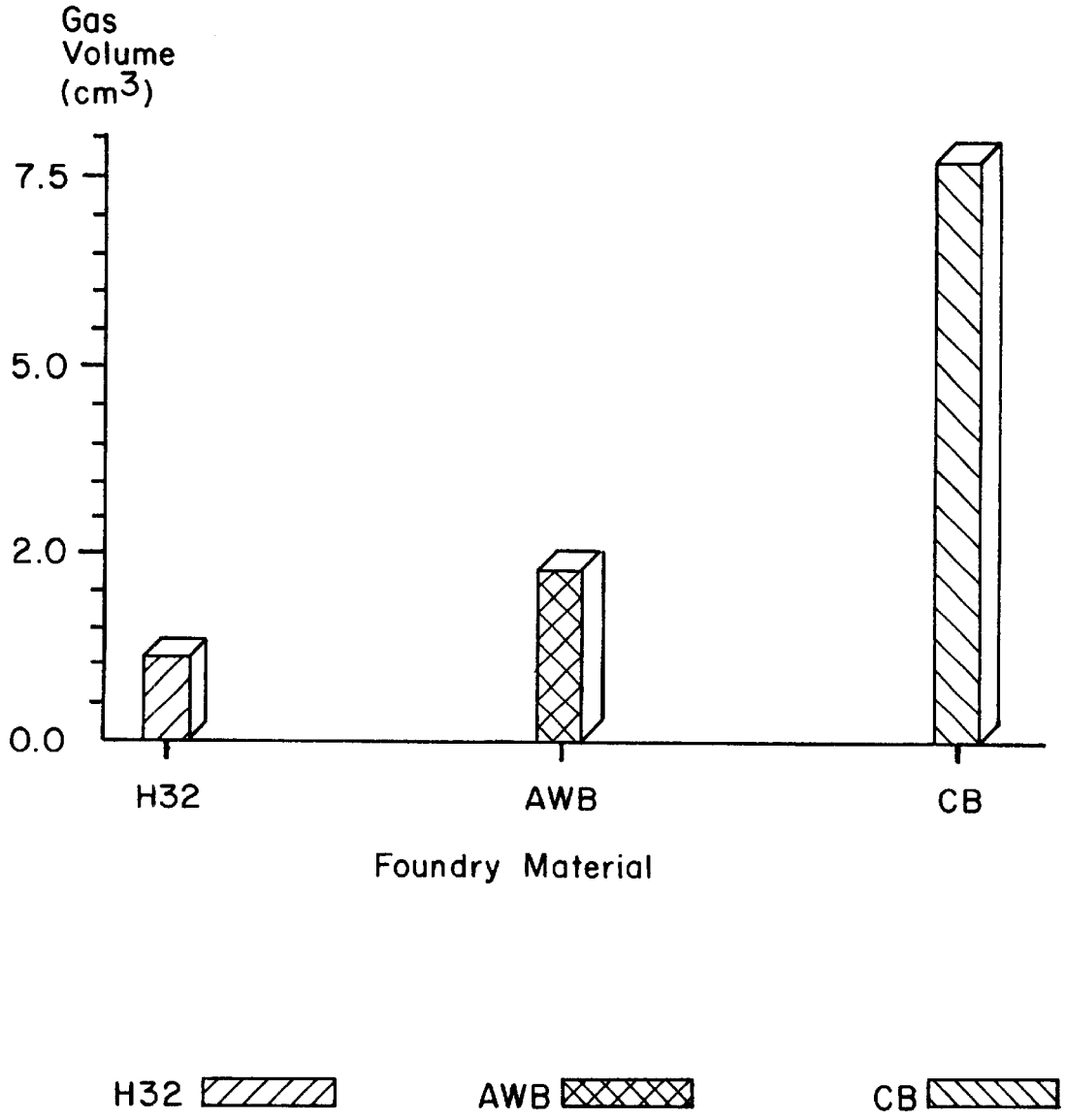
FIG. 7 shows a comparison of the gas volume produced with sand, AWB and CB products.

FIG. 7 compares the gas formation of cold box with that of AWB preforms under thermal stress.

System Parameters

Oven temperature 770° C.

Foundry material charge 2 g

The gas volume is corrected for the system, i.e., the calculations include the dead volume. Test duration: 7.5 minutes under thermal stress The samples were stored under common environmental conditions for 24 hours before the test. As used herein, the terms "molten phase" and "glass phase" are synonymous. The terms refer to the glass phase which is formed if silica and sodium carbonate are heated above 600° C.

In summary, a method for producing a core preform for a foundry is provided. Accordingly, a mixture of an inorganic, refractory foundry sand and water-glass based inorganic binder is produced. This mixture is filled into a heated core box. The pressure of the heated core box is adjusted to a reduced pressure during filling. The water contained in the mixture is removed by a physical method (i.e. control of pressure and/or heat) and a core preform is formed. The core box is closed and the temperature and residence time in the core box is adjusted such that a dimensionally stable and load-bearing outer shell is formed on the preform. The core box is opened and the core preform is removed from the core box immediately after opening the core box and the core preform is completely dried with microwaves.

Further, a method is provided in which the reduced pressure is maintained in the range of about 100—about 400 mbar. The temperature of the core box is maintained in the range of about 150—about 200° C. The outer shell is formed in the heated core box in a time of about 10 to about 30 seconds. The core preform is completely dried and hardened through by microwaves in a time of about 30 to about 180 seconds. The core box may also be filled with a mixture of recycled core sand comprising about 1.5 to about 3.0 wt. % binder, relative to the proportion of sand, with the binder comprising about 20 to about 50 wt. % water-glass, the remainder being water. The recycled core sand contains a fraction of molten phases equal to or less than about 0.1 wt. %. The water content of the binder immediately before filling the core box is increased by about 20—about 40%. The reduced pressure is sufficient to remove at least the major portion of the water contained in the mixture.

Further, a method is provided for producing core sand from core preform material left over from producing a core preform for a foundry. The core preform is produced by the steps of first producing a mixture of an inorganic, refractory foundry sand and a water-glass based inorganic binder, filling the mixture into a heated core box, adjusting the pressure of the heated core box to a reduced pressure during filling, removing water contained in the mixture by a physical method and forming a core preform, closing the core box and adjusting the temperature and residence time in the core box such that a dimensionally stable and load-bearing outer shell is formed on the preform, opening the core box and removing the core preform from the core box immediately after opening the core box and completely drying the core preform with microwaves. The process steps include de-agglomerating the left over material (which has a binder concentration of 1.5 to 3%) to an initial primary grain size. The primary grain comprises a dehydrated water-glass binder outer shell which is free of organic residues and free sodium carbonate (free soda) so that the fraction of molten phases in the recycling core sand is equal to or less than about 0.1 wt. % and the quantity of water-glass is in the range of about 1.5 and about 3.0 wt. % relative to the quantity of silica sand, with a maximum solid fraction of about 50 wt. % relative to the binder. Further, the primary grain fraction in the recycling core sand mixture is equal to or less than about 99 wt. %. The de-agglomeration step is performed in a jaw crusher of a cross pane mill and the producing of the mixture is performed in a vibrating mixer without sizing.

What is claimed is:

1. A method for producing a core preform for a foundry, comprising the steps of (a) producing a mixture of recycled inorganic, refractory foundry sand and water-glass based inorganic binder comprising about 1.5 to about 3.0 wt. % binder relative to the proportion of sand, with the binder comprising about 20 to about 50 wt. % water-glass, the rest being water, the fraction of molten phases in the sand being equal to or less than about 0.1 wt. %;

(b) filling a heated core box with said mixture;

(c) adjusting the pressure of the heated core box to a reduced pressure during filling;

(d) removing water contained in the mixture and forming a core preform;

(e) adjusting the temperature and residence time of the mixture in the core box after it has been closed such that a dimensionally stable and load-bearing outer shell is formed on the preform;

(f) opening the core box;

(g) removing the core preform from the core box immediately after opening the core box; and (h) completely drying the core preform with microwaves.

2. A method of producing a recyclable core sand from a core preform produced in accordance with claim 1, comprising the step of de-agglomerating the material from said core preform to an initial primary grain which comprises a dehydrated water-glass binder outer shell which is free of organic residues and free soda.

3. The method according to claim 2, wherein the de-agglomeration step is performed in a jaw crusher of a cross pane mill and the producing of the mixture is performed in a vibrating mixer without sizing.

* * * * *